United States Patent [19]

Kurtz

[11] 3,955,675

[45] May 11, 1976

[54] ONE-PIECE INTERNAL SUPPORT FOR A CATHODE RAY TUBE MULTIPACK CONTAINER

[75] Inventor: Joseph M. Kurtz, Ottawa, Ohio

[73] Assignee: GTE Sylvania Incorporated, Stamford, Conn.

[22] Filed: Apr. 16, 1975

[21] Appl. No.: 568,520

[52] U.S. Cl. ..... 206/419; 206/521; 229/39 B; 229/14 C

[51] Int. Cl.² ..... B65D 85/42; B65D 5/10

[58] Field of Search ..... 206/45.14, 45.34, 419–422, 206/433, 521, 523; 229/14 C, 39 B

[56] References Cited

UNITED STATES PATENTS

| | | | |
|---|---|---|---|
| 3,363,753 | 1/1968 | Taylor | 206/422 |
| 3,750,871 | 8/1973 | Cook | 206/433 |

*Primary Examiner*—George E. Lowrance
*Assistant Examiner*—Douglas B. Farrow
*Attorney, Agent, or Firm*—Norman J. O'Malley; Frederick H. Rinn; Robert T. Orner

[57] ABSTRACT

An improved internal support is incorporated in a multipack container for accommodating a plurality of cathode ray tubes during transportation and storage. The multipack construction includes top and bottom rigid closure members formed of plastic material in conjunction with peripherally oriented and edge positioned support. The internal supportive construction of the invention is oriented within the multipack in a manner to effect vertical support between the closure members. This improved support is formed from a unitary sheet of rigid material having predefined folding-scores therein, which when folded, provide individual protective compartments for two cathode ray tubes. The unitary construction of this internal supportive along with the multiple folds of the integration, provide improved structural rigidity and enhanced protective characteristics.

7 Claims, 5 Drawing Figures

Fig. 2

ONE-PIECE INTERNAL SUPPORT FOR A CATHODE RAY TUBE MULTIPACK CONTAINER

CROSS REFERENCE TO RELATED APPLICATION

This application contains matter disclosed but not claimed in a related United States patent application filed concurrently herewith and assigned to the assignee of the present invention. This related application is Ser. No. 568,519.

BACKGROUND OF THE INVENTION

This invention relates to packaging means for cathode ray tubes and more particularly to improved internal supportive means utilized in the packaging of a plurality of tubes for transportation and storage. In general, cathode ray tubes by the nature of their usual glass construction are inherently fragile structures. Therefore, in storing and transporting quantities of tubes, careful consideration must be directed to achieving appropriately sturdy packaging means. For some time, it has been conventional practice to transport and store pluralities of tubes in packaging means commonly referred to as multipacks or multipack containers. Depending upon the size of the tubes concerned, such containers are normally designed to accommodate six or more tubes per multipack unit. In the fabrication of this type of multiple tube packaging, it has been a common practice to utilize a combination of substantially corrugated paperboard components, such being individually cut, formed, and interlocked to produce an integrated container means. Such construction requires a number of expensive die-cut pieces to provide the container shell along with the several necessary internal structural supportive components, which are individually assembled thereinto, to fabricate a suitable container having the requisite strength to accommodate the plurality of tubes and adequately protect them against damage. It has been common practice to employ several carton members to achieve the required internal structural support for the container. Usually, multipack containers for cathode ray tubes are fabricated entirely of corrugated paperboard which has an inherent shortcoming in that the material is prone to absorb ambient humidity, whereupon the structural rigidity of the container becomes weakened thereby diminishing the supportive protection of the contents therein.

A recent development in multipack construction involves the usage of substantially rigid top and bottom closure members which are formed of expanded plastic material in place of the usual paperboard closure components. It is to this type of improved multipack construction that the improvement of the invention is primarily directed.

OBJECTS AND SUMMARY OF THE INVENTION

It is an object of the invention to reduce the aforementioned disadvantages by providing an improved internal supportive structure for a multipack container that exhibits improved structural rigidity and protective features. Another object is to provide an internal supportive member wherein the discretely folded portions effect a beneficial ruggedness to the container.

The foregoing and other objects and advantages are achieved in one aspect of the invention by the provision of an improvement in the internal supportive means employed in a cathode ray tube multipack container.

The improved construction is fabricated from a unitary sheet of substantially rigid material which is folded in a multiple manner to provide a two-compartment member for the accommodation of a pair of cathode ray tubes positioned within the multipack. The material is folded to define a dual-wall terminally-joined separation member which separates the two adjoining compartments. A plurality of tabular elements are extended from the lower edges of the several walls of the integrated structure for placement in recesses formed within the bottom closure member to effect positional attachment of the supportive means upon the closure.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

While the ensuing description is primarily directed to an exemplary multipack structure employing substantially rigid top and bottom closure members, the concept of the associated improved one-piece internal supportive means for accommodating a pair of cathode ray tubes therein is likewise applicable for adaptation to tube multipack containers of other types of construction.

Figure 1:
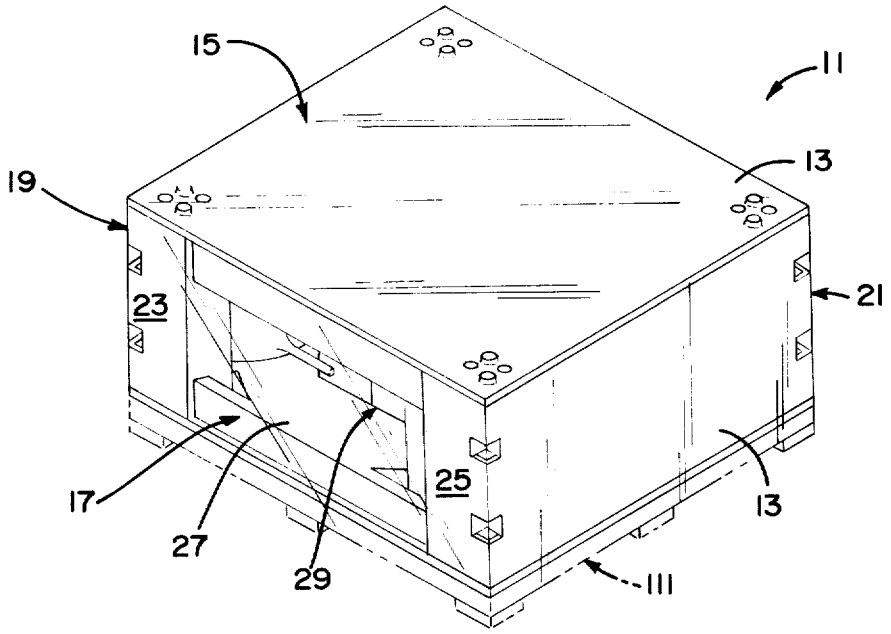
FIG. 1 is a perspective of a cathode ray tube multipack structure wherein the invention is incorporated.

In describing the invention, there is shown in FIG. 1 an example of a single multipack container 11 for accommodating a plurality of cathode ray tubes wherein the internal supportive means of the invention is employed. Exemplarily, the multipack shown is of the type having a taut covering of plastic film 13 applied thereover to provide an encompassing binding to the whole integrated structure. In this instance, the substantially rigid, spaced-apart and inversely superposed tray-like top and bottom closure members 15 and 17, are shown to have two substantially U-shaped edge-positioned side support members 19 and 21 that are opposingly oriented therebetween. The opposing extremital wing portions 23 and 25 of the respective side support members are separated in a manner to define a window means 27 through which the internal contents of the multipack container can be viewed, a portion of the internal supportive means 29 of the invention is discernible therein. The several cooperating structural components of the multipack container 11 are delineated in FIG. 2. The top and bottom closure portions 15 and 17 of the multipack are similar inversely superposed tray-like members which are formed of substantially rigid plastic material, such as, for example, expanded polystyrene. Each closure member has a plurality of configurated cavities 31 formed internally of the interior plane 33 to accommodate the placement and retention of a portion of the contourial surface of each of the respective cathode ray tubes to be positioned therein. Additionally, each of the respective closure members 15 and 17 contains a pluralilty of recesses 35, 35', 37, 37', 39, 39' and 41, 41' discretely formed therein to receive individual tabular elements associated with respective componental side support and internal supportive members 19, 21 and 29 comprising the container construction. The opposing side support members 19 and 21 are structurally formed of substantially rigid-board material, symmetrically folded in a predetermined vertical manner along score lines to provide similar square cornered structures. Each of these substantially U-shaped supporting structures has two extremital wing portions 23, 23' and 25, 25' which project from either side thereof along wall-formed ledges 43 and 45 of the opposed closure members. The opposing forward regions of these wing portions are separated from one another to effect a window opening therebetween 27 and 27' on both sides of the multipack structure.

Interiorly within the multipack enclosure are the internal supportive aand protective structural means 29 of the invention for accommodating two opposingly positioned cathode ray tubes. This improved internal structure includes first and second tube protective compartments 47 and 49 which are individually adapted for substantially encompassing the panel and funnel portions of the respective tubes positioned therein.

Figure 5:
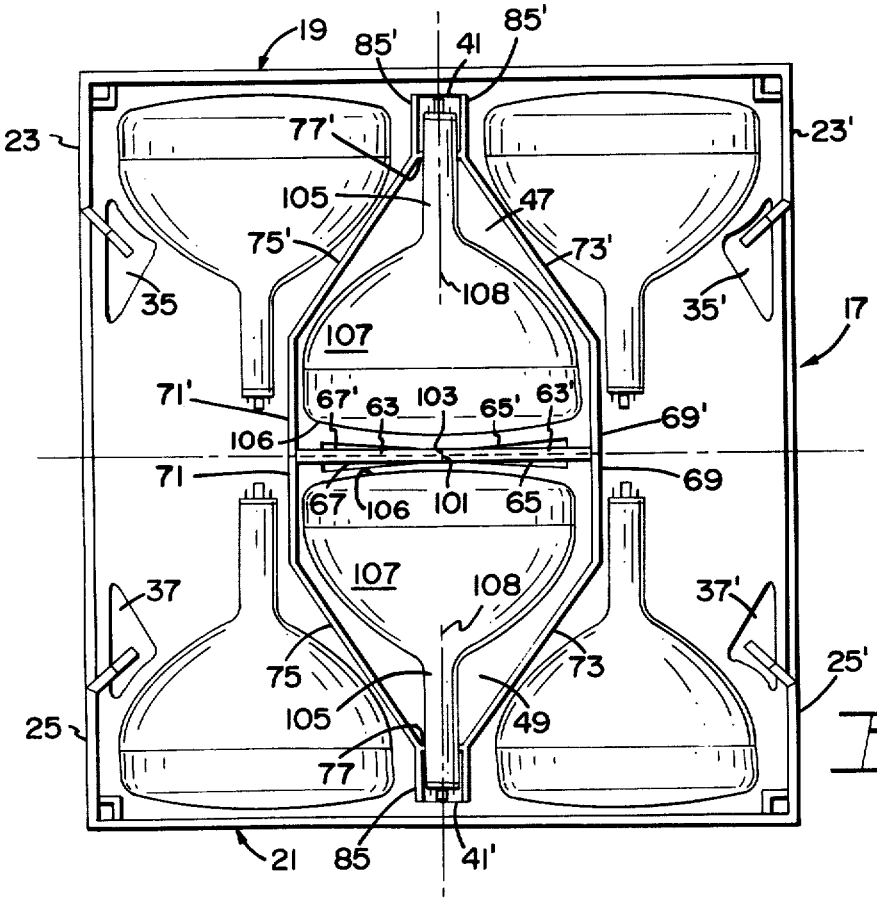
FIG. 5 is a plan view of a bottom closure member illustrating the positioning of the internal supportive means thereon.
Figure 3:
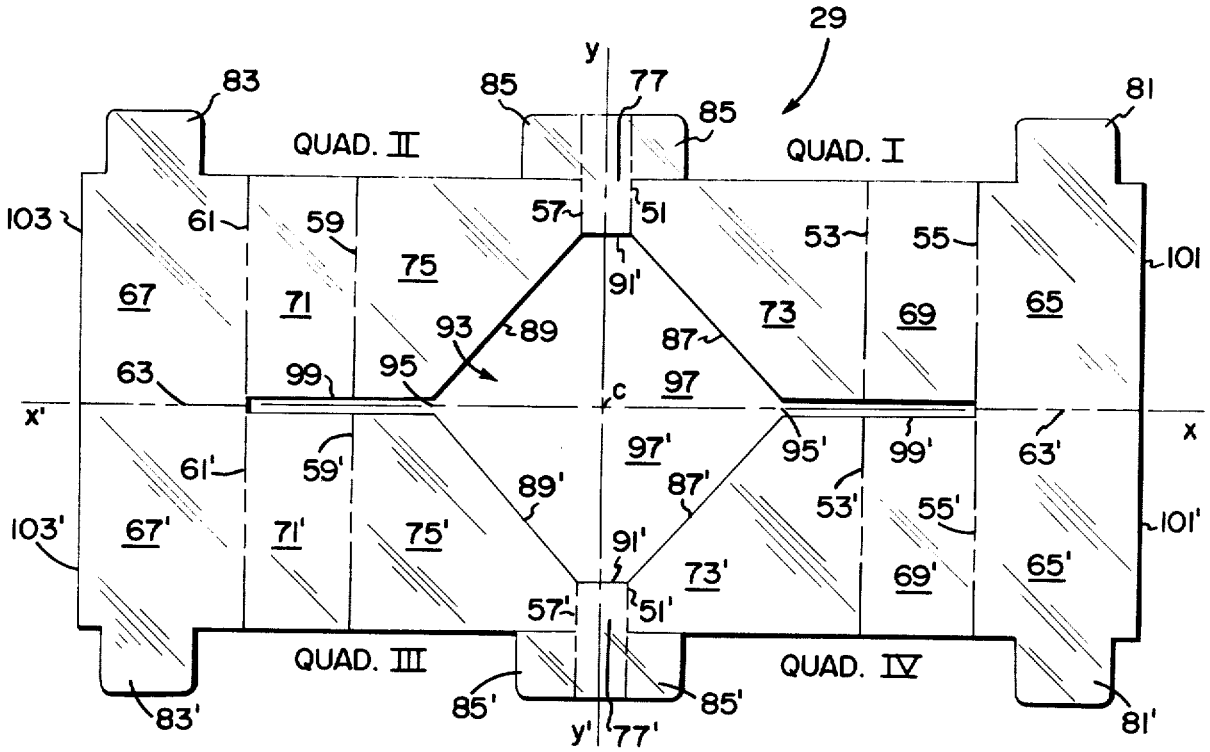
FIG. 3 is a plan view of the internal supportive structure illustrating the planar layout of the material before folding.
Figure 4:
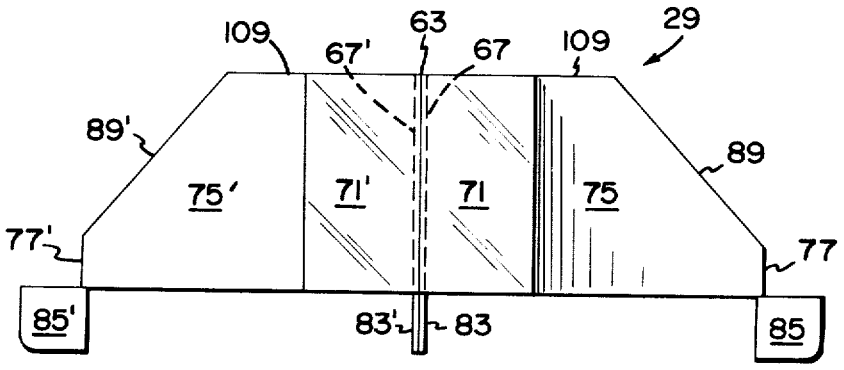
FIG. 4 is a side elevational showing the folded internal supportive member.

For detailed consideration of the invention, additional attention is directed to FIGS. 3, 4, and 5. The improved internal supportive means 29 providing the aforementioned duel compartmental tube protective structure is constructed from a unitary sheet of foldable substantially rigid material of substantially rectangular shaping as shown in FIG. 3. This discretely configurated planar member is fabricated of substantially rigid-board material which lends itself to defined folding along predetermined score lines, e.g., 51-51', 53-53', 55-55',57-57', 59-59', 61-61' and 63-63'. Suitable construction materials for this utilization are, for example, plastic corrugated board or corrugated paperboard. While these materials may be inflammable, they can be formulated by known means to exhibit flame retardative properties. To expedite description of the one-piece integrated supportive structure 29 of the invention, major *x-x'* and minor *y-y'* coordinate axes, having an intersection at C, are delineated to bidirectionally define the planar member into four quadrants. Such being delineated in a counterclockwise manner wherein Quadrant I includes that portion of the member defined by the axes designation *x-c-y*, Quadrant II by *x'-c-y*, Quadrant III by *x'-c-y'*, and Quadrant IV by *x-c-y'*, respectively. The first and fourth quadrants each have three predefined fold-score lines 51-51', 53-53' and 55-55', and the second and third quadrants each have three similarly defined fold-score lines 57-57', 59-59' and 61-61'. All of these score lines are spatially related therein in a manner parallel with the minor axes *y-y'*, and extend through the associated quadrants to sequentially define in the respective quadrantal areas: four outer portions 65, 65', 67, 67', four intermediate portions 69, 69', 71, 71'; four inner portions 73, 73', 75, 75', and two central areal jointure portions 77 and 77'. Each of the four outer portions 65, 65', 67, 67' and two jointure portions 77 and 77' have respective tabular elements 81, 81', 83, 83' and 85, 85' extending therefrom in a manner directionally parallel with the minor *y-y'* axis. The outer portions 65 and 65' of the first and fourth quadrants, and those similar portions 67 and 67' of the second and third quadrants are joined along respective score lines 63 and 63' coincident with the major *x-x'* axis. The inner 73, 73', 75, 75' and jointure 77, 77' portions of all quadrants have related cutout lines 87, 87', 89, 89' and 91, 91' therein peripherally arranged to conjunctively define a substantially symmetrical central opening 93 in the unitary sheet such as, for example, the substantially pseudo-hexagonal shaping shown in FIG. 3. The defined opening has two diametrically opposed points 95 and 95' which coincide with the *x-x'* axes thereby substantially bisecting the central opening into two similar open-base formed openings 97 and 97' as, for example, of substantially trapezoidal definition. Each of these diametrical points 95 and 95' has a cut-line 99 and 99' extending outwardly therefrom along the major *x-x'* axis to meet the two respective fold-score lines 63 and 63' delineating the joined contiguity of the respective outer portions 65, 65' and 67, 67'. For purposes of clarity, the sides of the cut-lines 99 and 99' are shown in FIG. 3 to be slightly separated to show the coincidence of the *x-x'* axis. While the central opening 93 is illustrated as being of substantially pseudo-hexagonal definition, an opening of ovate-shaping or modifications thereof, are intended to be within the breadth of the concept.

Figure 2:
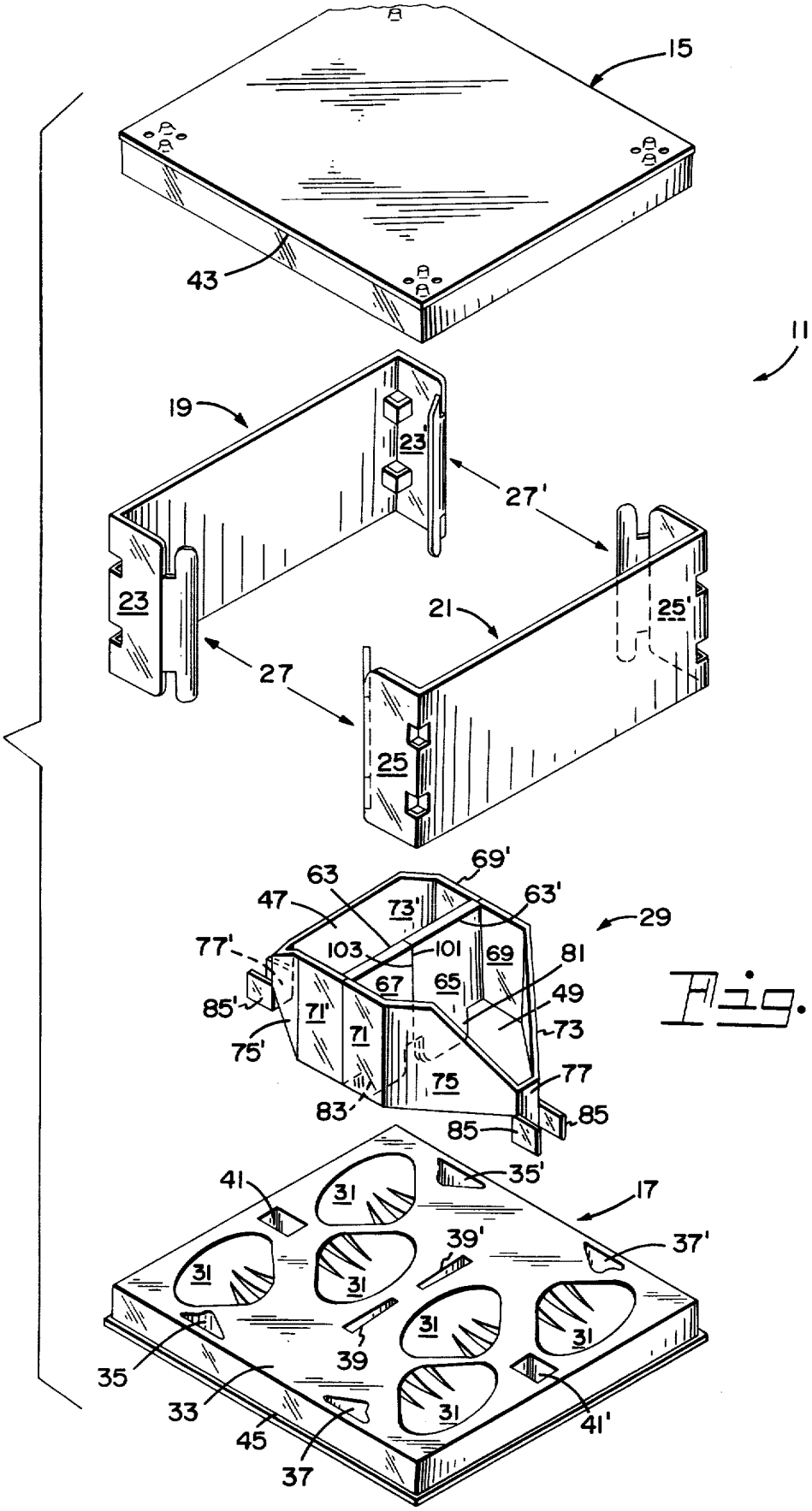
FIG. 2 is an exploded view of the multipack structure delineating the respective parts thereof.

To form the internal supportive structure 29, the unitary sheet is sequentially folded along the minor axes-related score lines in a unidirectional manner, as for example, upward from the plane of the FIG. 3 drawing to consummate a meeting of the edges 101-101' and 103-103' of the respective outer portions 65, 65' and 67, 67' to provide juxtapositioned alignment of those portions, whereupon the related *x-x'* score lines 63 and 63' thereof are in extended longitudinal orientation as shown in FIGS. 2 and 5 to effect an integration of first 47 and second 49 open-end tube accommodating compartments. Subsequent folding along the *x-x'* score lines 63 and 63' effects substantially adjacent back-to-back positioning of the juxtapositionally aligned outer portions 65, 65' and 67, 67' of the two compartments. Thus, the respective conjunctively related inner portions 73, 73', and 75, 75' and the associated jointure portions 77 and 77', which define the two similarly formed openings, 97 and 97', are disposed in opposed positionings to afford accommodation for the extended neck portions 105 of the cathode ray tubes 107 positioned therein. Upon completed folding, the related tabular elements 81, 81', 83, 83' and 85, 85' are oriented in a common direction to effect placement in the respective recesses 39, 39', and 41, 41' formed in the bottom closure member 17 to effect positional attachment of the improved internal supporting structural means 29 upon the bottom closure member. The tabular elements 85 and 85' are delineated as extending from the respective opposed central jointure portions 77 and 77', such being in the form of wing projections folded outward in a manner normal to the jointure portions along score-lines parallel to the minor *y-y'* axis. Upon insertion of these tabular elements into the compatibly formed recesses 41 and 41', the jointure portions 77 and 77' of the integrated supportive means are positively positioned and definitively spaced from the peripheral side support means 19 and 21.

As shown in FIG. 5, the internal supportive means of the invention is oriented substantially centrally between the top and bottom closure members in a manner spatially isolated from the side supporting means of the multipack container. Such spacing provides protective enhancement by effecting a fire retardative barrier within the container. Upon assembling the individual and internal supportive member and the opposing positioned side support members upon the bottom closure member 17, the respective plurality of cathode ray tubes 107 are positioned therein, with the face panels 106 being in proximal orientation within the supportive member, and whereof the longitudinal axes 108 and the neck portions 105 of the tubes are substantially parallel with the plane of the closure member. The top closure member 15 is then seated thereupon in a manner resting flush upon the top edge 109 of the rigidly formed internal supportive member 29 to provide an integrated multipack 11 evidencing a rugged central support. At this stage, the plastic material is applied to the multipack as a tight covering 13 contiguously encompassing the assemblage, which may or may not be supported upon a pallet 111, as phantomed in FIG. 1. This plastic covering may be in the form of a heat shrinkable plastic bag suitably dimensioned to fit over the assemblage, or it can be effected by a stretch wrap operation; both means being well known in the packaging art.

The one-piece internal support means of the invention, which expeditiously supplants a plurality of separate structural pieces, provides an improved supportive member that exhibits marked structural rigidity and improved protective features for the tubes associated therewith. The multiple folds in the one-piece integration provide a beneficial structural integration which produces enhanced supportive characteristics to the multipack container, especially when stacking arrangements are considered.

While there have been shown and described what are at present considered the preferred embodiments of the invention, it will be obvious to those skilled in the art that various changes and modifications may be made therein without departing from the scope of the invention as defined by the appended claims.

What is claimed is:

1. An improvement in the supportive means for accommodating and protecting a pair of cathode ray tubes positioned in opposed orientation upon a substantially rigid tray-like closure member having a plurality of spatially oriented cavities formed therein to receive portions of the panel and funnel areas of said tubes, with the longitudinal axes and neck portions of said tubes being substantially parallel with said closure member, and wherein said closure member has a plurality of recesses to facilitate securement of said tube protective means thereon, said improvement comprising:

supportive means having integral first and second tube protective compartments adapted for substantially encompassing the panel and funnel portions of said cathode ray tubes, said compartments being formed from a one piece unitary sheet of substantially rigid material utilizing a series of predefined folding scores therein to provide a plurality of upstanding opposingly oriented side walls and a related plurality of upstanding opposingly oriented end walls, one of said end walls of said first compartment being a primary wall formed of two juxtapositioned componental parts placed in back-to-back alignment with a correspondingly formed primary end wall of said second compartment thereby defining a dual-wall terminally-joined separation member for separating said first and second compartments, the other of said upstanding end walls of each of said compartments being an opposed secondary wall and having a cut out region therein for accommo dating the extended neck portions of said respective tubes; and a plurality of tabular elements extending from the lower edges of said upstanding opposingly oriented end-walls of said compartments shaped for placement in said recesses formed within said closure member to effect positional attachment of said improved supportive means upon said closure member.

2. In a multipack container for accommodating a plurality of cathode ray tubes wherein the retention thereof is effected between two spaced-apart and inversely superposed tray-like members formed of substantially rigid material conjunctively serving as top and bottom closure means associated with peripheral side supporting means forming said container, and wherein each of said closure members has a plurality of cavities formed therein to accommodate a portion of the contourial surface of each of the respective tubes supported therebetween and an additional plurality of recesses formed to receive tubular construction elements of said multipack container, an improvement oriented within said multipack in the form of supportive means fashioned to accommodate and protect substantially the panel and funnel portions of a pair of adjacently opposed tubes positioned with the face panels thereof in proximal orientation and the longitudinal axes thereof in substantially parallel relationship with said top and bottom closure members, said structural improvement comprising:

supportive means in the form of an integrated dua compartmental tube protective means fabricatec from a unitary sheet of foldable substantially rigic material of substantially rectangular shaping hav ing major $x$-$x'$ and minor $y$-$y'$ coordinate axes bidi rectionally defining four quadrants thereof, th first and fourth quadrants and the second and thir quadrants each having three predefined fold-scor lines spatially related therein in a manner paralle with said minor axis and extended through sai associated quadrants to sequentially define outer intermediate, inner and central jointure areal por tions in each quadrantal area; each of said oute and jointure portions having a tabular elemen extending therefrom in a manner directionally pa allel with said minor axis, the outer portions of sai first and fourth quadrants and those of said secon and thrid quadrants being joined along respectiv score lines coincident with said $x$-$x'$ axis, said inne and jointure portions of all quadrants having r lated cut out lines therein arranged to conjun tively define a substantially symmetrical centr opening in said unitary sheet of which two diame rically opposed points coincide with said $x$-$x'$ ax thereby substantially bisecting said central openir into two similar open-base formed openings, eac of said diametrical points having a cut-line exten ing outwardly therefrom along said $x$-$x'$ axis meet the two respective fold-score lines delineati contiguity of the respective outer portions, sa unitary sheet being sequentially folded along sa minor axis-related score lines in a unidirectional manner to consummate a meeting of the edges of said outer portions to provide juxtapositioned alignment of those portions whereupon the related $x$-$x'$ score lines thereof are in extended longitudinal orientation to effect an integration of first and second open-end tube accommodating compartments, subsequent folding along said $x$-$x'$ score lines effects substantially adjacent back-to-back positioning of the juxtapositionally aligned outer portions of said compartments thereby disposing said respective inner and jointure portions defining the formed openings in opposed positionings to afford accommodation for the extended neck portions of the tubes positioned therein, said related tabular elements being oriented in a common direction for placement in the respective recesses in said bottom closure member.

3. The improvement in the supportive means for protecting a pair of cathode ray tubes within a multipack container according to claim 2 wherein said rigid material is of corrugated construction board, and wherein said closure members are of rigid plastic foam.

4. The improvement in the supportive means for protecting a pair of cathode ray tubes within a multipack structure according to claim 2 wherein said integration comprised of two like open-end encompassing tube protective chambers is oriented substantially centrally between said closure members in a manner spacedly isolated from the side supporting means of said multipack container.

5. The improvement in the supportive means for protecting a pair of cathode ray tubes within a multipack container according to claim 2 wherein said tabular elements extending from said respective central jointure portions each have a wing projection on either side folded normal to the jointure portions along scorelines parallel to said minor $y$-$y'$ axis for insertion into recesses in said bottom closure member to effect placement of the central jointure portions away from the sidewall supporting means.

6. The improvement in the supportive means for protecting a pair of cathode ray tubes within a multipack container according to claim 2 wherein said top closure member rests flush upon the top of said dual tube protective means.

7. The improvement in the supportive means for protecting a pair of cathode ray tubes in a multipack container according to claim 2 wherein said centrally defined opening is substantially pseudo-hexagonal in shape whereof said diametrically opposed points are opposed vertices, and wherein said related open-base formed openings are substantially trapezoidal in shape.

* * * * *

UNITED STATES PATENT OFFICE

CERTIFICATE OF CORRECTION

Patent No. 3,955,675 Dated May 11, 1976

Inventor(s) Joseph M. Kurtz Page 1 of 3

It is certified that error appears in the above-identified patent and that said Letters Patent are hereby corrected as shown below:

Columns 1, 2, 5 and 6 should be substituted by the columns as shown on the attached sheets.

Signed and Sealed this

Fourteenth Day of September 1976

[SEAL]

*Attest:*

RUTH C. MASON
*Attesting Officer*

C. MARSHALL DANN
*Commissioner of Patents and Trademarks*

ONE-PIECE INTERNAL SUPPORT FOR A CATHODE RAY TUBE MULTIPACK CONTAINER

CROSS REFERENCE TO RELATED APPLICATION

This application contains matter disclosed but not claimed in a related United States patent application filed concurrently herewith and assigned to the assignee of the present invention. This related application is Ser. No. 568,519.

BACKGROUND OF THE INVENTION

This invention relates to packaging means for cathode ray tubes and more particularly to improved internal supportive means utilized in the packaging of a plurality of tubes for transportation and storage. In general, cathode ray tubes by the nature of their usual glass construction are inherently fragile structures. Therefore, in storing and transporting quantities of tubes, careful consideration must be directed to achieving appropriately sturdy packaging means. For some time, it has been conventional practice to transport and store pluralities of tubes in packaging means commonly referred to as multipacks or multipack containers. Depending upon the size of the tubes concerned, such containers are normally designed to accommodate six or more tubes per multipack unit. In the fabrication of this type of multiple tube packaging, it has been a common practice to utilize a combination of substantially corrugated paperboard components, such being individually cut, formed, and interlocked to produce an integrated container means. Such construction requires a number of expensive die-cut pieces to provide the container shell along with the several necessary internal structural supportive components, which are individually assembled thereinto, to fabricate a suitable container having the requisite strength to accommodate the plurality of tubes and adequately protect them against damage. It has been common practice to employ several carton members to achieve the required internal structural support for the container. Usually, multipack containers for cathode ray tubes are fabricated entirely of corrugated paperboard which has an inherent shortcoming in that the material is prone to absorb ambient humidity, whereupon the structural rigidity of the container becomes weakened thereby diminishing the supportive protection of the contents therein.

A recent development in multipack construction involves the usage of substantially rigid top and bottom closure members which are formed of expanded plastic material in place of the usual paperboard closure components. It is to this type of improved multipack construction that the improvement of the invention is primarily directed.

OBJECTS AND SUMMARY OF THE INVENTION

It is an object of the invention to reduce the aforementioned disadvantages by providing an improved internal supportive structure for a multipack container that exhibits improved structural rigidity and protective features. Another object is to provide an internal supportive member wherein the discretely folded portions effect a beneficial ruggedness to the container.

The foregoing and other objects and advantages are achieved in one aspect of the invention by the provision of an improvement in the internal supportive means employed in a cathode ray tube multipack container.

The improved construction is fabricated from a unitary sheet of substantially rigid material which is folded in a multiple manner to provide a two-compartment member for the accommodation of a pair of cathode ray tubes positioned within the multipack. The material is folded to define a dual-wall terminally-joined separation member which separates the two adjoining compartments. A plurality of tabular elements are extended from the lower edges of the several walls of the integrated structure for placement in recesses formed within the bottom closure member to effect positional attachment of the supportive means upon the closure.

BRIEF DESCRIPTION OF THE DRAWINGS

FIG. 1 is a perspective of a cathode ray tube multipack structure wherein the invention is incorporated;

FIG. 2 is an exploded view of the multipack structure delineating the respective parts thereof;

FIG. 3 is a plan view of the internal supportive structure illustrating the planar layout of the material before folding;

FIG. 4 is a side elevational showing the folded internal supportive member; and FIG. 5 is a plan view of a bottom closure member illustrating the positioning of the internal supportive means thereon.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

While the ensuing description is primarily directed to an exemplary multipack structure employing substantially rigid top and bottom closure members, the concept of the associated improved one-piece internal supportive means for accommodating a pair of cathode ray tubes therein is likewise applicable for adaptation to tube multipack containers of other types of construction.

In describing the invention, there is shown in FIG. 1 an example of a single multipack container 11 for accommodating a plurality of cathode ray tubes wherein the internal supportive means of the invention is employed. Exemplarily, the multipack shown is of the type having a taut covering of plastic film 13 applied thereover to provide an encompassing binding to the whole integrated structure. In this instance, the substantially rigid, spaced-apart and inversely superposed tray-like top and bottom closure members 15 and 17, are shown to have two substantially U-shaped edge-positioned side support members 19 and 21 that are opposingly oriented therebetween. The opposing extremital wing portions 23 and 25 of the respective side support members are separated in a manner to define a window means 27 through which the internal contents of the multipack container can be viewed, a portion of the internal supportive means 29 of the invention is discernible therein. The several cooperating structural components of the multipack container 11 are delineated in FIG. 2. The top and bottom closure portions 15 and 17 of the multipack are similar inversely superposed tray-like members which are formed of substantially rigid plastic material, such as, for example, expanded polystyrene. Each closure member has a plurality of configurated cavities 31 formed internally of the As shown in FIG. 5, the internal supportive means of the invention is oriented substantially centrally between the top and bottom closure members in a manner spatially isolated from the side supporting means of the multipack container. Such spacing provides protective enhancement by effecting a fire retardative barrier within the container. Upon assembling the individual and internal supportive member and the opposing positioned side support members upon the bottom closure member 17, the respective plurality of cathode ray tubes 107 are positioned therein, with the face panels 106 being in proximal orientation within the supportive member, and whereof the longitudinal axes 108 and the neck portions 105 of the tubes are substantially parallel with the plane of the closure member. The top closure member 15 is then seated thereupon in a manner resting flush upon the top edge 109 of the rigidly formed internal supportive member 29 to provide an integrated multipack 11 evidencing a rugged central support. At this stage, the plastic material is applied to the multipack as a tight covering 13 contiguously encompassing the assemblage, which may or may not be supported upon a pallet 111, as phantomed in FIG. 1. This plastic covering may be in the form of a heat shrinkable plastic bag suitably dimensioned to fit over the assemblage, or it can be effected by a stretch wrap operation; both means being well known in the packaging art.

The one-piece internal support means of the invention, which expeditiously supplants a plurality of separate structural pieces, provides an improved supportive member that exhibits marked structural rigidity and improved protective features for the tubes associated therewith. The multiple folds in the one-piece integration provide a beneficial structural integration which produces enhanced supportive characteristics to the multipack container, especially when stacking arrangements are considered.

While there have been shown and described what are at present considered the preferred embodiments of the invention, it will be obvious to those skilled in the art that various changes and modifications may be made therein without departing from the scope of the invention as defined by the appended claims.

What is claimed is:

1. An improvement in the supportive means for accommodating and protecting a pair of cathode ray tubes positioned in opposed orientation upon a substantially rigid tray-like closure member having a plurality of spatially oriented cavities formed therein to receive portions of the panel and funnel areas of said tubes, with the longitudinal axes and neck portions of said tubes being substantially parallel with said closure member, and wherein said closure member has a plurality of recesses to facilitate securement of said tube protective means thereon, said improvement comprising:

supportive means having integral first and second tube protective compartments adapted for substantially encompassing the panel and funnel portions of said cathode ray tubes, said compartments being formed from a one piece unitary sheet of substantially rigid material utilizing a series of predefined folding scores therein to provide a plurality of upstanding opposingly oriented side walls and a related plurality of upstanding opposingly oriented end walls, one of said end walls of said first compartment being a primary wall formed of two juxtapositioned componental parts placed in back-to-back alignment with a correspondingly formed primary end wall of said second compartment thereby defining a dual-wall terminally-joined separation member for separating said first and second compartments, the other of said upstanding end walls of each of said compartments being an opposed secondary wall and having a cut out region therein for accommo dating the extended neck portions of said respective tubes; and a plurality of tabular elements extending from the lower edges of said upstanding opposingly oriented end-walls of said compartments shaped for placement in said recesses formed within said closure member to effect positional attachment of said improved supportive means upon said closure member.

2. In a multipack container for accommodating a plurality of cathode ray tubes wherein the retention thereof is effected between two spaced-apart and inversely superposed tray-like members formed of substantially rigid material conjunctively serving as top and bottom closure means associated with peripheral side supporting means forming said container, and wherein each of said closure members has a plurality of cavities formed therein to accommodate a portion of the contourial surface of each of the respective tubes supported therebetween and an additional plurality of recesses formed to receive tubular construction elements of said multipack container, an improvement oriented within said multipack in the form of supportive means fashioned to accommodate and protect substantially the panel and funnel portions of a pair of adjacently opposed tubes positioned with the face panels thereof in proximal orientation and the longitudinal axes thereof in substantially parallel relationship with said top and bottom closure members, said structural improvement comprising:

supportive means in the form of an integrated dual compartmental tube protective means fabricated from a unitary sheet of foldable substantially rigid material of substantially rectangular shaping having major $x$-$x'$ and minor $y$-$y'$ coordinate axes bidirectionally defining four quadrants thereof, the first and fourth quadrants and the second and third quadrants each having three predefined fold-score lines spatially related therein in a manner parallel with said minor axis and extended through said associated quadrants to sequentially define outer, intermediate, inner and central jointure areal portions in each quadrantal area; each of said outer and jointure portions having a tabular element extending therefrom in a manner directionally parallel with said minor axis, the outer portions of said first and fourth quadrants and those of said second and thrid quadrants being joined along respective score lines coincident with said $x$-$x'$ axis, said inner and jointure portions of all quadrants having related cut out lines therein arranged to conjunctively define a substantially symmetrical central opening in said unitary sheet of which two diametrically opposed points coincide with said $x$-$x'$ axis thereby substantially bisecting said central opening into two similar open-base formed openings, each of said diametrical points having a cut-line extending outwardly therefrom along said $x$-$x'$ axis to meet the two respective fold-score lines delineating contiguity of the respective outer portions, said unitary sheet being sequentially folded along said